US005370514A

United States Patent [19]

Morita et al.

[11] Patent Number: 5,370,514

[45] Date of Patent: Dec. 6, 1994

[54] ROTARY PUMP WITH SHAFT/ROTOR CONNECTION

[75] Inventors: Kazuo Morita, Hirakata; Tokuji Yamamoto, Misima, both of Japan

[73] Assignee: Nakakin Co., Ltd., Osaka, Japan

[21] Appl. No.: 80,827

[22] Filed: Jun. 21, 1993

[30] Foreign Application Priority Data

Jun. 29, 1992 [JP] Japan ..... 4-045036[U]

[51] Int. Cl.[5] ..... F01C 1/18

[52] U.S. Cl. ..... 418/206; 418/205

[58] Field of Search ..... 418/191, 205, 206

[56] References Cited

U.S. PATENT DOCUMENTS

| | | | |
|---|---|---|---|
| 3,023,706 | 3/1962 | DeFezzy et al. | 418/206 |
| 3,126,834 | 3/1964 | Bursak | 418/206 |
| 3,182,900 | 5/1965 | Thorson | 418/191 |

FOREIGN PATENT DOCUMENTS

| | | | |
|---|---|---|---|
| 2241559 | 9/1991 | United Kingdom | 418/206 |

*Primary Examiner*—Richard A. Bertsch
*Assistant Examiner*—Charles G. Freay
*Attorney, Agent, or Firm*—Schweitzer Cornman & Gross

[57] ABSTRACT

A rotary pump having a plurality of rotor structures disposed in a pump casing, each structure having a rotor disposed in a casing, a hollow drive shaft each for driving said rotor, a headed bolt disposed within the hollow drive shaft for attaching said rotor to the drive shaft, an internally threaded rotor shaft being attached to the rotor and having said bolt threaded therein, the rotor shaft being disposed within an enlarged diameter hollow end of the hollow drive shaft, and the head of the bolt is disposed at the end of the hollow drive shaft opposite to its end to which the rotor is attached, whereby no rotor attaching means are employed on the face of the rotor opposite to the rotor shaft, and the pump casing has a flat rotor cover over the rotor structures, without any substantial spaces between the rotor cover and the rotors.

2 Claims, 3 Drawing Sheets

ROTARY PUMP WITH SHAFT/ROTOR CONNECTION

FIELD OF THE INVENTION

The present invention relates to a rotary pump useful for transporting liquid foods.

BACKGROUND OF THE INVENTION

Conventionally, in a rotary pump such as can be used for transporting liquid foods, a rotary drive shaft is formed with its leading end in a spline shaft, a spline hole formed through a rotor is engaged by the spline shaft of the rotors of the pump within a pumping chamber in a main rotor casing, and a fastening nut of the rotors is engaged and fixed at the end of the rotor drive shafts projected outwardly from the rotor, and a concave casing cover receives the rotor segments and the rotor fastening nut.

In such a conventional rotary pump, a transported liquid flows in the pumping chamber, enters into the concave part inside the casing cover through a space between the rotor and the casing cover, and tends to be retained in that concave part, becoming trapped therein. Since the so trapped food can spoil, the pumps of this type have to be frequently disassembled and the pump with the concave part inside the casing cover cleaned after a day's use of the pump. Reassembly of such pumps after their disassembly, and their cleaning requires the expenditure of considerable time and labor thus increasing the cost of the product.

SUMMARY OF THE INVENTION

It is an objective of the present invention to provide a rotary pump that allows the forming of a flat cover for the pump casing opposite the rotors, without any concavity by fixing the rotors to respective rotor drive shafts without using a front rotor fastening nut, and thus eliminating deep bag-like parts such as a concave part within the front cover of the casing and thereby eliminating retention of liquid as in the conventional rotary pumps as described above.

For achieving the aforementioned objective, the present invention comprises a rotary pump with rotors having respective hollow rotor drive shafts, a headed long bolt with a threaded end inserted into the hollow rotor drive shaft for threaded rigid engagement between the bolt with its drive shaft and a threaded hole within the rotor.

Pumping segments of the rotors engage each other in a pumping chamber of the main casing. A Long bolt is inserted into the hollow rotor drive shaft that is supported in a gearbox, the threaded end of the bolt is screwed into the threaded hole of the shaft portion of the rotor, and rotating the head of the bolt such as by spanner, the rotor is drawn into the chamber and toward the rotor drive shaft, and is fastened therein. Therefore, the rotor can be rigidly connected with, and fastened to, the rotor drive shaft from the opposite end of the pump rigidly attached to the leading end of rotor drive shaft by abutment thereagainst, thus the conventional rotor fastening nut is eliminated, rigidity of the connection between the rotor its drive shaft can be significantly increased, and sufficient resistance to high pressure is obtained. Furthermore, the rotors can be easily removed merely by removing the casing cover, and loosening the fastening bolt of the rotor.

Since for connecting a rotor to a rotor drive shaft it is not required to provide a rotor connecting bolt through the rotor and fastening it with a fastening nut from the front of the rotor, the casing cover opposite to the rotors can be flat, thus eliminating the deep bag-like, concave parts in the casing cover. This eliminates the problem of retention of liquids as observed in conventional rotary pumps of the prior art. This avoids decaying and quality deterioration of liquid foods, and cleaning of the pumps is also substantially simplified.

According to an embodiment of the present invention, a shaft portion of the rotor is engaged in an enlarged hollow part in the leading end of a rotor drive shaft. This permits the alignment of the rotor and the rotor drive shaft with a higher precision, and significantly enhanced rigidity of connection between the rotor and rotor drive shaft.

DESCRIPTION OF THE DRAWING

The novel features of the invention will be better understood and appreciated along with other objects and features thereof, from the following detailed description taken in conjunction with the drawings, wherein.

Figure 1:
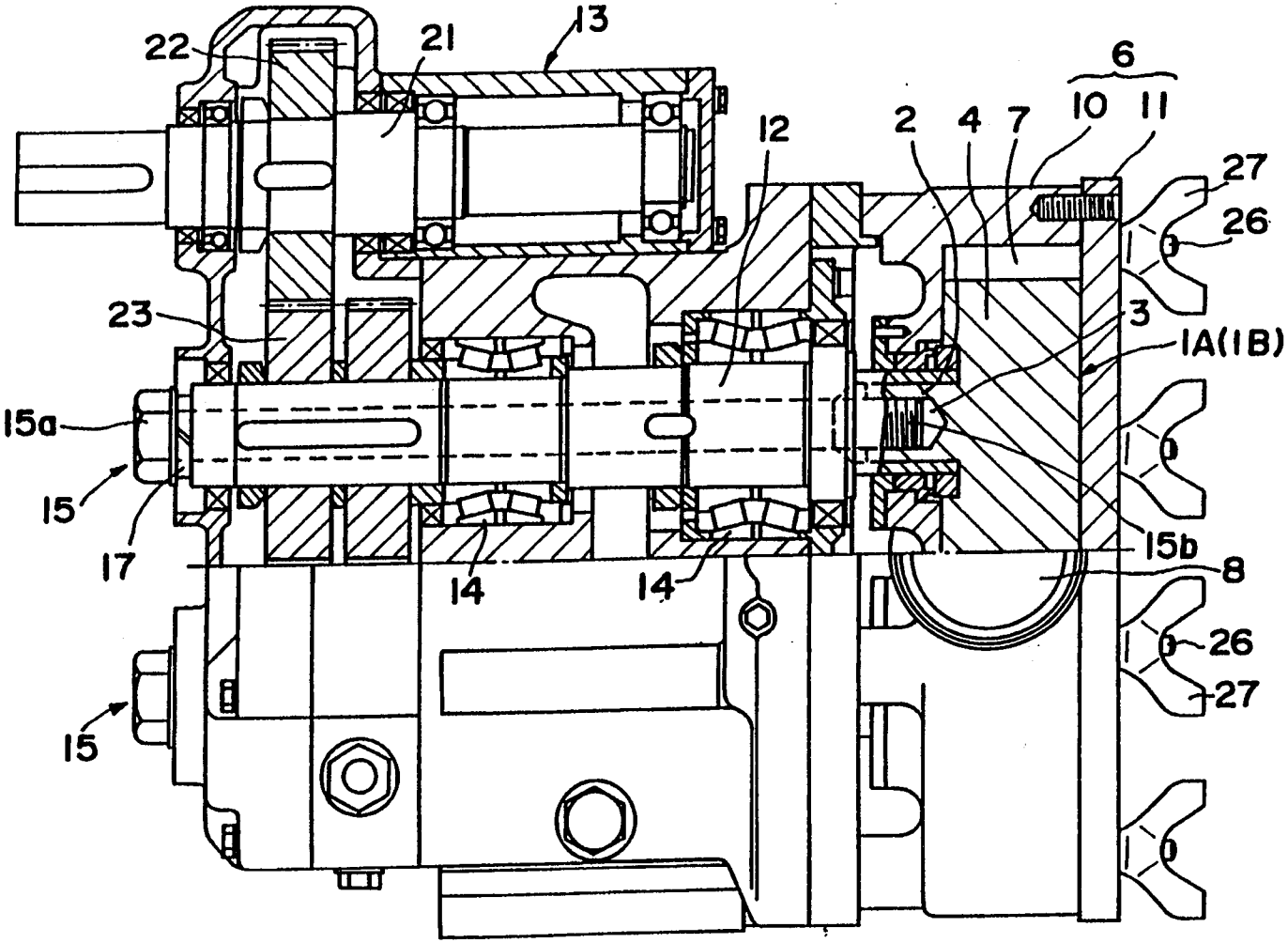
FIG. 1 is a cross-sectional view of a rotary ump according to the invention, showing a vertically sectioned half thereof.
Figure 2:
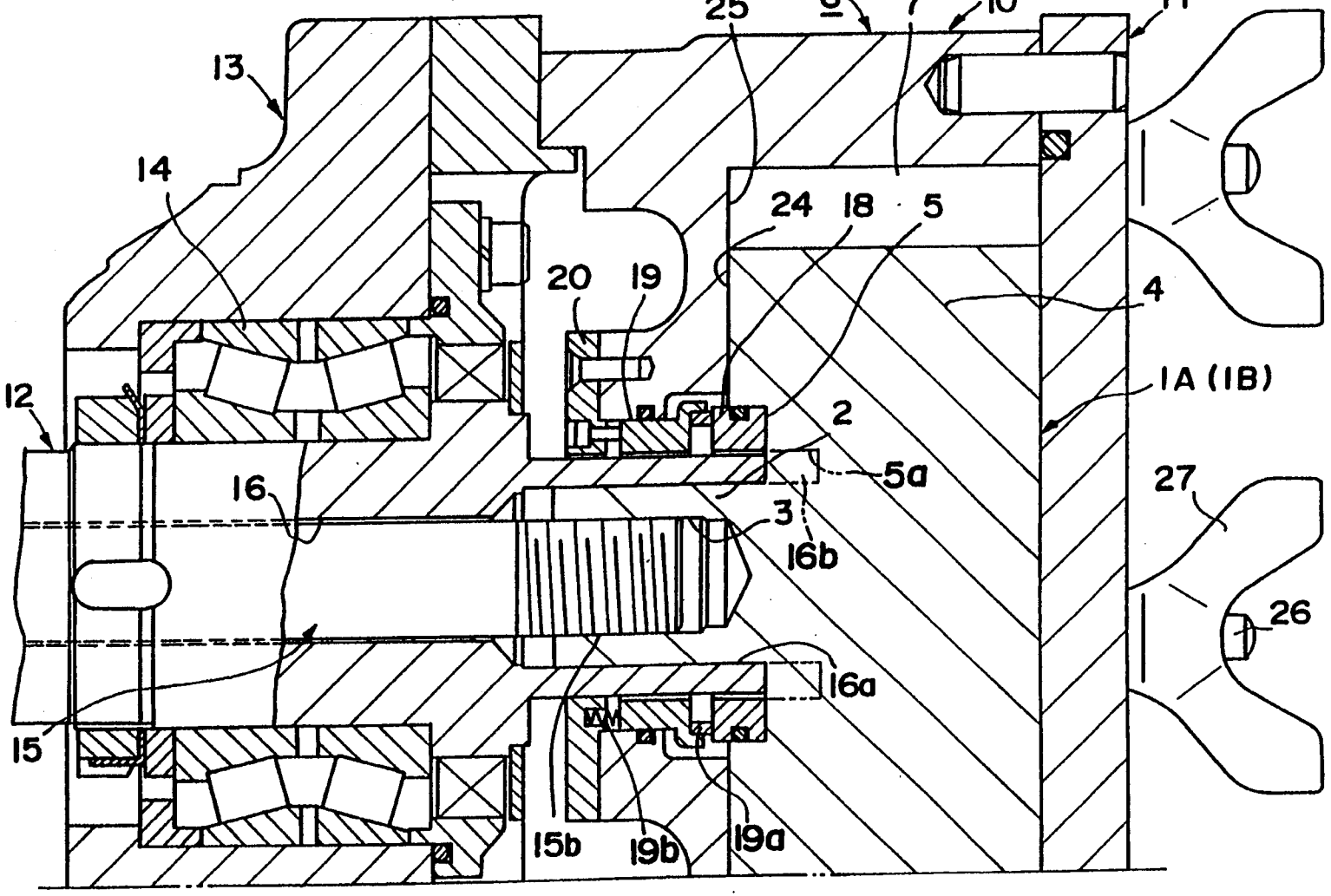
FIG. 2 is a partially magnified view of FIG. 1.

It will be recognized that some or all of the figures are schematic representations for purposes of illustration, and do not necessarily depict the actual relative sizes or locations of the elements shown.

DETAILED DESCRIPTION

A rotor shaft portion 2, projects from either a rotor 1A and 1B in the central part of an end surface of the rotary pump. A threaded hole 3 of deeply concave shape is provided in a leading end of the rotor shaft 2 in the axial direction. Pumping segments are integrally formed in a circumferential part, and an annular groove 5 in the outer circumference of rotor shaft 2 at its foot.

A pump casing 6 comprises a main casing 10 that has a concave pumping chamber 7 adopted to contain the pumping segments of the rotors 1A and 1B. An inlet 8 and an outlet 9 are provided in the main casing 10 communicating with the pumping chamber 7 therein. A casing cover 11 that is detachably mounted to the main casing 10 flush with the end surfaces of the rotors 1A and 1B.

Rotor drive shafts 12 (with only one shaft being shown) are provided for each of the rotors 1A and 1B. Each rotor drive shaft is axially immobilized and is rotatably disposed by bearings 14 and a gearbox 13. Since each drive for a rotor 1A and 1B is identical to the other, they are being described herein in general terms. The rotor drive shaft 12 is hollow in its interior 16. A rotor fastening bolt 15 is inserted in the hollow part 16 of the hollow rotor drive shaft 12 from one end to the other thereof, and a bolt head **15*a* is locked against rotation by a lockwasher 17** against the end surface of a rotor drive shaft.

The diameter of the drive shaft 12 and its hollow interior 16 is enlarged at its leading end and the rotor shaft portion 2 of the rotor 1 is inserted in a hollow portion **16*a* within the increased diameter of the hollow interior of the shell. A threaded end 15*b* of the rotor fastening bolt 15 is engaged in the threaded hole 3 of the rotor shaft portion 2, thereby connecting the rotor drive shaft 12 with the rotor 1. Shaft seals 18 and 19 are provided in a space respectively between the inner surface of the rotor 1, the outer surface of rotor shaft portion 2 and the main casing 10 of the pump casing 6. The seal 18 is engaged in the annular groove 5 in the outer circumference of rotor shaft portion 2, at its foot. The seals 18 is rotated integrally with the rotor 1, while the other seal 19 is fixed to the main casing 10 and is prevented from rotation. Therefore, the leading end 19***a* of the fixed seal 19 is suitably formed from a very hard material such as a ceramic, while the rotating seal at the opposite side thereof is suitably formed from tungsten carbide or the like. The leading end 19*a* of the fixed seal 19 is based by a spring 19*b* into contact with the rotating seal 18 so that a watertight condition is maintained between them. A holder 20 keeps the sealing members 18, 19 in place and is attached to the side of the main casing 10.

As shown in FIG. 1, a transmission shaft 21 is rotatably supported in the gearbox 13, and is connected to a motor (not shown), rotation of the transmission shaft 21 is transmitted through the gearbox 13 to a first one of the rotor drive shafts 12, by gears 22, 23, and rotation of the one so driven rotor drive shaft 12 is transmitted to the other rotor drive shaft 12 in a manner known per se (by means not shown) so that the direction of rotation of the other rotor drive shaft 12 is synchronously the opposite from the direction of rotation of the first one.

In assembling a rotary pump of the present invention, the pumping segments 4 of the rotors 1A, 1B are engaged in pumping chamber 7 of the main casing 10, and the rotor shaft portions 2 are engaged in the hollow leading portions 16*a* of the hollow rotor drive shafts 12 that are driven from the gearbox 13. Then, the rotor fastening bolt 15 is inserted in each rotor drive shaft 12 from the end, the threaded leading part 15*b* thereof is screwed into the threaded hole 3 of the rotor shaft 2, and each of the rotors 1A and 1B are drawn in toward the rotor drive shaft 12 and fastened by rotating and tightening the bolt head 15*a*, such as by a spanner.

By tightening the rotor fastening bolt 15 the rotor 1 is tightly connected to the rotor drive shaft 12 with the leading end surface of the rotor drive shaft 12 tightly abutting against the inner end surface 24 of the rotors, and particularly against the deep end surface of the annular groove 5. In this operation, the inner end surface 24 of the rotor 1 is set so that a minimum clearance is provided for its rotation in relation with the inner end surface of the pumping chamber 7. Thus, after the rotor 1 is connected to the rotor drive shaft 12, the casing cover 11 is attached to the main casing 10 of the pump casing 6 so that it is flush along the mounting end surface of main casing 10 and the outer end surface of rotors 1A and 1B. Thus, the casing cover 11 assures a minimum clearance for rotation of the rotors between it and the outer end surfaces of rotors 1A and 1B.

In attaching the pump casing 6, the main casing 10 is attached to the gearbox 13, and the casing cover 11 is attached to the main casing 10 through a plurality of axial through holes (not shown) in the circumferential part of the main casing 10 and casing cover 11. Assembly bolts 26 projecting from the side of gearbox 13 are inserted into the through holes and are tightened by wing nuts 27.

Figure 3:
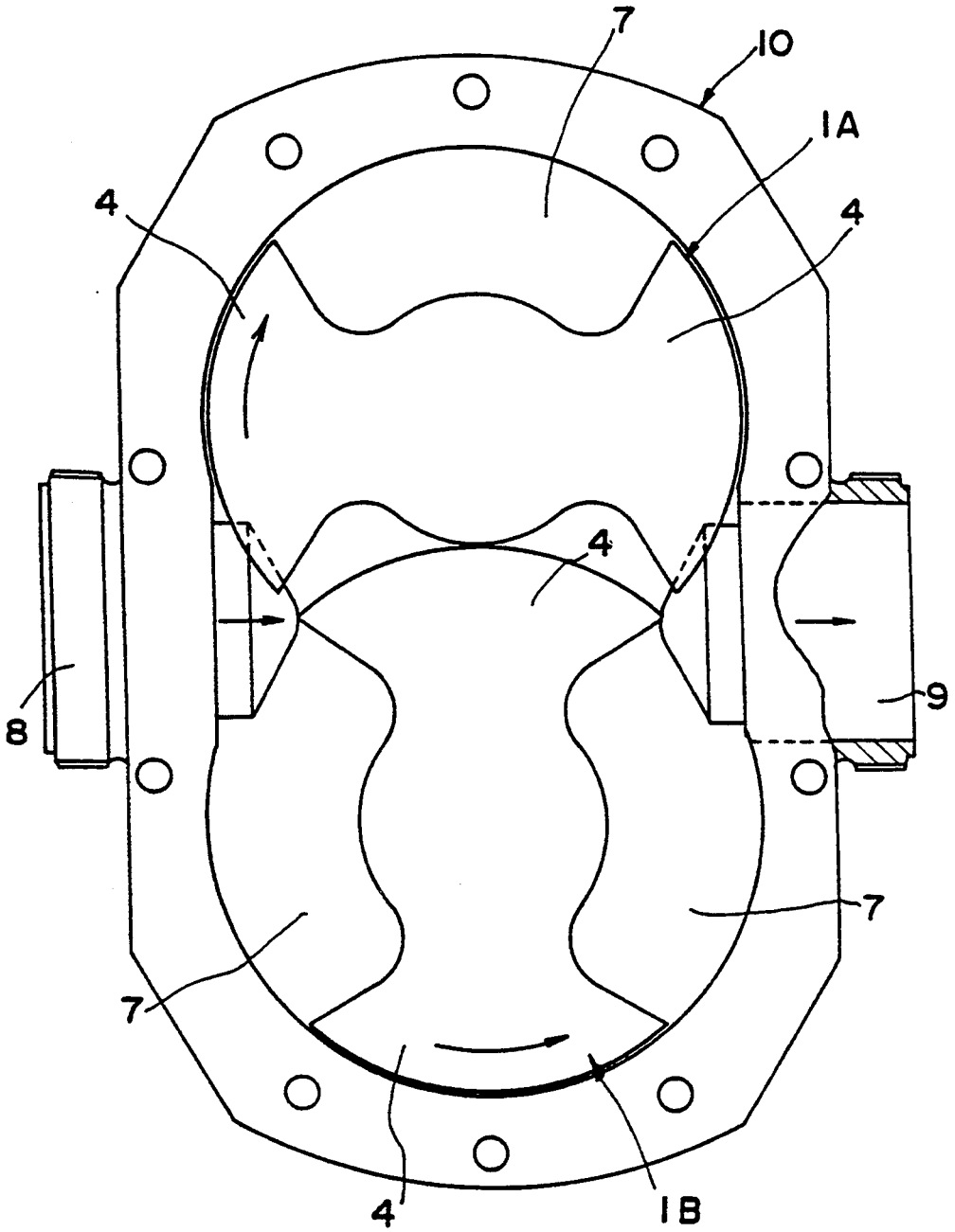
FIG. 3 is an end elevational view of a rotary pump with its casing cover removed.

In the rotary pump of the present invention synchronously driving the rotors 1A and 1B in opposite directions, as shown by an arrow in FIG. 3 by means of the respective rotor drive shafts 12, due to the action of the pumping segments 4 rotating in the pumping chamber 7, a liquid is sucked in through the inlet 8 into the pumping chamber 7, and is pumped toward the outlet 9. It is not required in the pump of the present invention to provide a fastening bolt through the rotor for connecting the rotor to the rotor drive shaft, and engage it with a fastening nut, as in pumps of the prior art, therefore the casing cover opposite to the rotor is flat and thus the entire inner surface of casing cover 11 is flush with the outer end surface of rotors 1A, 1B and has no concavity between the rotors 1A and 1B. Thus, there is no retention of the liquid being transported by the pump and the liquid does not flow in the pumping chamber but only directly from the inlet to the outlet. Therefore, cleaning of the interior of the pumping chamber 7 can be simply and easily performed.

Moreover, the rotors 1A, 1B, can be easily removed simply by removing the wing nuts 27 and the casing cover 11 and then loosening the rotor bolts 15.

In the suitable embodiment of the present invention described hereinabove the leading end of hollow rotor drive shaft 12 has an enlarged inner diameter so that the rotor shaft portion 2 of the rotor 1 can be inserted in the enlarged diameter hollow portion 16*a*. In an alternative embodiment, the rotor 1 can be fastened to the rotor drive shaft 12, instead of providing the hollow portion 16*a* with an increased diameter. Thus, the leading end surface of rotor shaft portion 2 is abutted against the leading end surface of the rotor drive shaft 12. However, by placing the rotor shaft portion 2 of the rotor 1 in the hollow leading portion of rotor drive shafts 12, in the described suitable embodiment the rotor 1 can be aligned with the rotor drive shaft 12 faster, simpler and with higher precision, and rigidity of connection between the rotor 1 and rotor drive shaft 12.

The hollow leading portion 16*a* of the rotor drive shaft 12 can be further extended to form an extended portion 16*b* fitting into a deeper groove portion 5*a* in the annular groove 5, so that they are aligned by tightly fitting the outer circumferential 10 surface of the extended drive shaft portion 16*b* into the inner circumferential surface of deep groove portion 5*a*. In that case, the extended portion 16*a* and the rotor shaft portion 2 can be in loose engagement with each other.

Although the present invention has been described in terms of the suitable embodiment, it is to be understood that such disclosure is not to be interpreted as limiting the invention to that embodiment.

What is claimed is:

1. A rotary pump for pumping matter therewith, the pump having a motor, a plurality of rotor structures disposed in a pump casing, each rotor structure comprising a rotor disposed in the casing, a hollow drive shaft each for transmitting rotary movement to each of the rotors, said hollow drive shaft having first and second ends, a rotor attaching bolt having a rotor attaching head, said rotor attaching bolt being disposed within said hollow drive shaft for attaching a rotor to its drive shaft, an internally threaded rotor shaft integral with said rotor and having said bolt threaded therein, said rotor shaft being disposed entirely within an enlarged diameter hollow first end of said hollow drive shaft, first said end having an edge, said attaching head being disposed at said second end of said hollow drive shaft opposite to said first end thereof, whereby said bolt is employed only at said second end, an annular groove in said rotor facing said hollow drive shaft and exterior of said internally threaded rotor shaft, said edge being tightly fastened within said annular groove by said bolt, whereby said hollow drive shaft is adapted to rotate concentrically with said internally threaded rotor shaft.

2. The rotary pump of claim 1, further comprising a flat rotor cover over the rotor structures without any spaces for material accumulation of pumped matter between the rotor cover and the rotors.

* * * * *